US008926038B2

(12) United States Patent
Tamaki

(10) Patent No.: US 8,926,038 B2
(45) Date of Patent: Jan. 6, 2015

(54) LIQUID EJECTION APPARATUS, CONTROLLER THEREFOR, NONVOLATILE STORAGE MEDIUM STORING PROGRAM FOR CONTROLLING THE APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 77 days.

(21) Appl. No.: 13/360,445

(22) Filed: Jan. 27, 2012

(65) Prior Publication Data

US 2012/0194584 A1 Aug. 2, 2012

(30) Foreign Application Priority Data

Jan. 31, 2011 (JP) ..... 2011-017874

(51) Int. Cl.
*B41J 29/38* (2006.01)
*B41J 2/18* (2006.01)
*B41J 2/165* (2006.01)

(52) U.S. Cl.
CPC ... *B41J 2/18* (2013.01); *B41J 2/165* (2013.01)
USPC ..... 347/9; 347/29

(58) Field of Classification Search
CPC .. B41J 2/04541; B41J 2/0458; B41J 2/04581; B41J 2/04588; B41J 2/04543
USPC ..... 347/9, 10, 12, 23, 29; 239/68
See application file for complete search history.

(56) References Cited

U.S. PATENT DOCUMENTS 4,223,324 A 9/1980 Yamamori et al.
6,398,331 B1 6/2002 Asaka et al.
6,685,300 B1 * 2/2004 Ishiyama et al. ..... 347/23
2001/0003349 A1 * 6/2001 Hosono ..... 239/68
2005/0116974 A1 * 6/2005 Suzuki ..... 347/10

(Continued)

FOREIGN PATENT DOCUMENTS

JP H03-184852 A 8/1991
JP 2000-229418 A 8/2000

(Continued)

OTHER PUBLICATIONS

Japan Patent Office, Notification of Reason for Refusal for Japanese Patent Application No. 2011-017874 (counterpart Japanese patent application), mailed Mar. 5, 2013.

(Continued)

*Primary Examiner* — Manish S Shah
*Assistant Examiner* — Yaovi Ameh
(74) *Attorney, Agent, or Firm* — Baker Botts L.L.P.

(57) ABSTRACT

A liquid ejection apparatus including: a head having an ejection face having ejection openings through which liquid is ejected, an ejection space being defined so as to face the ejection face; a sealing mechanism configured to selectively establish a sealing state for sealing the ejection space and an unsealing state; a humid-air supply mechanism configured to supply humid air into the ejection space in the sealing state; and a controller. The controller controls the humid-air supply mechanism to humidify the ejection space such that a humidity in the ejection space becomes equal to or higher than a predetermined humidity. The controller controls the head to perform a non-ejection flushing in at least one of a humidification period in which the humid-air supply mechanism humidifies the ejection space and a post-humidification period that extends for a first period from a completion of the humidification.

15 Claims, 9 Drawing Sheets

(56) References Cited

U.S. PATENT DOCUMENTS

| | | | | |
|---|---|---|---|---|
| 2005/0168517 | A1* | 8/2005 | Usuda | 347/29 |
| 2007/0052744 | A1* | 3/2007 | Mitsuki et al. | 347/12 |
| 2007/0076025 | A1 | 4/2007 | Nagashima | |
| 2007/0139487 | A1* | 6/2007 | Sekiguchi | 347/70 |
| 2008/0218554 | A1 | 9/2008 | Inoue | |
| 2009/0033707 | A1 | 2/2009 | Shimazaki | |
| 2009/0195593 | A1 | 8/2009 | Iwanaga | |
| 2009/0273621 | A1* | 11/2009 | Folkers et al. | 347/9 |
| 2012/0194605 | A1 | 8/2012 | Tamaki et al. | |

FOREIGN PATENT DOCUMENTS

| | | | |
|---|---|---|---|
| JP | 2003-334962 | A | 11/2003 |
| JP | 2005-212138 | A | 8/2005 |
| JP | 2006-130828 | A | 5/2006 |
| JP | 2006-159717 | A | 6/2006 |
| JP | 2007-098652 | A | 4/2007 |
| JP | 2008-221534 | A | 9/2008 |
| JP | 2009-034912 | A | 2/2009 |
| JP | 2009-184132 | A | 8/2009 |

OTHER PUBLICATIONS

European Patent Office, extended European Search Report for European Patent Application No. 12152831.9 (counterpart European patent application), dated Jun. 14, 2012.

* cited by examiner

LIQUID EJECTION APPARATUS, CONTROLLER THEREFOR, NONVOLATILE STORAGE MEDIUM STORING PROGRAM FOR CONTROLLING THE APPARATUS

CROSS REFERENCE TO RELATED APPLICATION

The present application claims priority from Japanese Patent Application No. 2011-017874, which was filed on Jan. 31, 2011, the disclosure of which is herein incorporated by reference in its entirety.

BACKGROUND OF THE INVENTION

1. Field of the Invention

The present invention relates to a liquid ejection apparatus configured to eject liquid such as ink, a controller for controlling the apparatus, and a nonvolatile storage medium storing a program for controlling the apparatus.

2. Description of the Related Art

An ink-jet printer as one example of a liquid ejection apparatus includes an ink jet head (liquid ejection head) having a multiplicity of ejection openings through which liquid such as ink is ejected to record an image on a recording medium. Here, a viscosity of the liquid in the head may increase by vaporization of water (water content) of the liquid via the ejection openings. This increase in the viscosity of the liquid in the head (especially in the ejection openings) may cause various problems such as clogging of the ejection opening, leading to an ejection failure.

As a technique for preventing the increase in the viscosity of the liquid in the head, there are known: a technique for discharging high-viscosity liquid by preliminary ejection that includes purging (that is an operation for driving a pump so as to apply pressures to the liquid in the head to eject the liquid from all the ejection openings) and flushing (that is an operation for driving actuators of the head on the basis of flushing data (different from image data) to eject the liquid from part or all of the ejection openings); and a technique for humidifying an ejection space facing the ejection openings, in a state in which the ejection space is sealed or capped by the cap. It is noted that water vaporization of the liquid in the ejection openings can be suppressed by the humidification. In addition to this effect, it is possible to consider that even if the viscosity of the liquid in the ejection opening has already increased, water (water content) is supplied to the liquids in the ejection opening by the humidification, making it possible to lower (recover) the viscosity of the liquid in the ejection opening to a value within a proper range.

SUMMARY OF THE INVENTION

However, frequent preliminary ejections lead to an increase in an amount of waste liquid. In the case of the humidification of the ejection space, the increase in the amount of the waste liquid can be prevented. However, the viscosity of the liquid in the head decreases from part of the liquid near the ejection opening toward an upstream side thereof in a direction of a flow of the liquid in the head when the liquid is ejected from the ejection opening. Thus, a relatively long time may be required for lowering a viscosity of part of the liquid located on an upstream side of the ejection opening in the liquid-flow direction, and the viscosity of the liquid in the ejection opening may become too low. If the viscosity of the liquid in the ejection opening is excessively low, each of a size (volume) and a speed of a liquid droplet ejected from the ejection opening may deviate from a predetermined value, and a density of the liquid may become too low, which may deteriorate an image quality.

This invention has been developed in view of the above-described situations, and it is an object of the present invention to provide a liquid ejection apparatus capable of having a viscosity of liquid in a head fall within a proper range while suppressing an amount of waste liquid, a controller for the apparatus, and a nonvolatile storage medium storing a program for controlling the apparatus.

The object indicated above may be achieved according to the present invention which provides a liquid ejection apparatus comprising: a liquid ejection head having an ejection face that has a plurality of ejection openings formed therein, the liquid ejection head being configured to eject liquid through the plurality of ejection openings to record an image on a recording medium, an ejection space being defined so as to face the ejection face; a sealing mechanism configured to selectively establish (i) sealing state in which the sealing mechanism seals the ejection space from an outside and (ii) an unsealing state in which the sealing mechanism does not seal the ejection space from the outside; a humid-air supply mechanism configured to supply, into the ejection space, humid air that has been humidified when the sealing mechanism is in the sealing state; and a controller configured to control the liquid ejection head, the sealing mechanism, and the humid-air supply mechanism, wherein the controller is configured to control the sealing mechanism and the humid-air supply mechanism to humidify the ejection space when the sealing mechanism is in the sealing state, such that a humidity in the ejection space becomes equal to or higher than a predetermined humidity, and wherein the controller is configured to control the liquid ejection head to perform a non-ejection flushing in at least one of (i) a humidification period in which the humid-air supply mechanism humidifies the ejection space and (ii) a post-humidification period that extends for a first period from a completion of the humidification of the ejection space by the humid-air supply mechanism, the non-ejection flushing being an operation for vibrating a meniscus of the liquid formed in at least one of the plurality of ejection openings without ejecting the liquid from the at least one of the plurality of ejection openings.

The object indicated above may be achieved according to the present invention which provides a controller configured to control a liquid ejection apparatus, the liquid ejection apparatus comprising: a liquid ejection head having an ejection face that has a plurality of ejection openings formed therein, the liquid ejection head being configured to eject liquid through the plurality of ejection openings to record an image on a recording medium, an ejection space being defined so as to face the ejection face; a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply, into the ejection space, humid air that has been humidified when the sealing mechanism is in the sealing state, the controller comprising: controlling the sealing mechanism and the humid-air supply mechanism to humidify the ejection space when the sealing mechanism is in the sealing state, such that a humidity in the ejection space becomes equal to or higher than a predetermined humidity; and controlling the liquid ejection head to perform a non-ejection flushing in at least one of (i) a humidification period in which the humid-air supply mechanism, humidifies the ejection space and (ii) a post-humidification period that extends for a first period from a completion of the humidification of the ejection space by the humid-air supply mechanism, the non-ejection flushing being an operation for vibrating a meniscus of the liquid formed in at least one of the plurality of ejection openings without ejecting the liquid from the at least one of the plurality of ejection openings.

The object indicated above may be achieved according to the present invention which provides a nonvolatile storage medium storing a program for controlling a liquid ejection apparatus, the liquid ejection apparatus comprising: a liquid ejection head having an ejection face that has a plurality of ejection openings formed therein, the liquid ejection head being configured to eject liquid through the plurality of ejection openings to record an image on a recording medium, an ejection space being defined so as to face the ejection face; a sealing mechanism configured to selectively establish (i) a, sealing state in which the sealing mechanism seals the ejection space from an outside and (ii) an unsealing state in. which the sealing mechanism does not seal the ejection space from the outside; and a humid-air supply mechanism configured to supply, into the ejection space, humid air that has been humidified when the sealing mechanism is in the sealing state, the program being designed to: control the sealing mechanism and the humid-air supply mechanism to humidify the ejection space when the sealing mechanism is in the sealing state, such that a humidity in the ejection space becomes equal to or higher than a predetermined humidity; and control the liquid ejection head to perform a non-ejection flushing in at least one of (i) a humidification period in which the humid-air supply mechanism humidifies the ejection space and (ii) a post-humidification period that extends for a first period from a completion of the humidification of the ejection space by the humid-air supply mechanism, the non-ejection flushing being an operation for vibrating a meniscus of the liquid formed in at least one of the plurality of ejection openings without ejecting the liquid from the at least one of the plurality of ejection openings.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
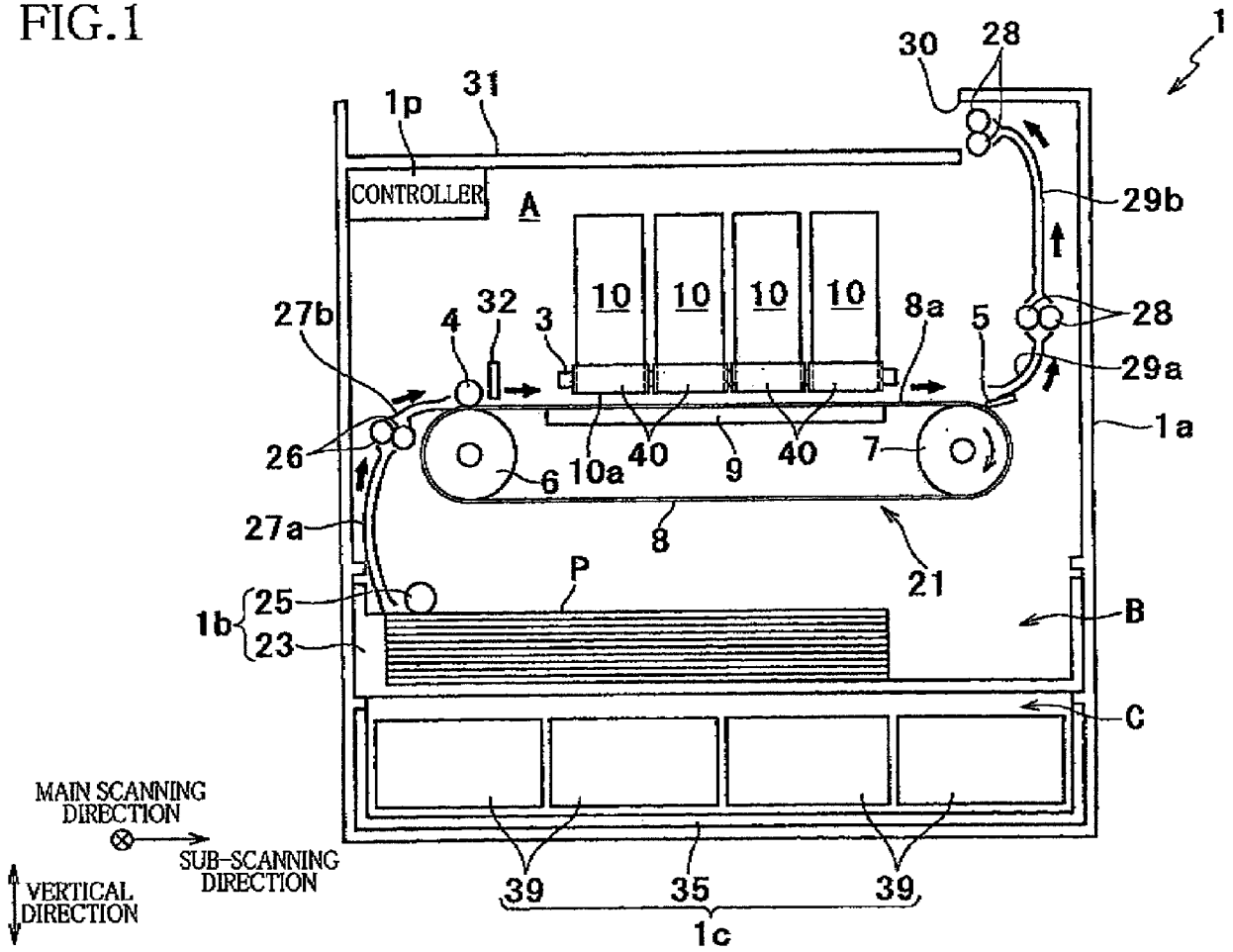
FIG. 1 is a side view generally showing an internal structure of an ink-jet printer as an embodiment of a liquid ejection apparatus to which the present invention is applied.

Hereinafter, there will be described an embodiment of the present invention by reference to the drawings.

First, there will be explained an overall construction of an ink-jet printer 1 as an embodiment of a liquid ejection apparatus to which the present invention is applied.

The printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from an upper side thereof. In the spaces A and B is formed a sheet conveyance path extending from a sheet-supply unit 1*b* to the sheet-discharge portion 31.

In the space A, there are arranged four heads 10, a conveyance mechanism 21, a guide unit, a controller 1*p*, a humidifying mechanism 50 (see FIG. 5), and so on.

Each of the heads 10 is a line head having a generally rectangular parallelepiped shape elongated in a main scanning direction in which each head 10 reciprocates. A lower face of each head 10 is an ejection face 10*a* having a multiplicity of the ejection openings 14*a* opened therein. In a recording operation (image forming), the four heads 10 eject inks of respective four colors, namely, magenta, cyan, yellow, and black from the respective ejection faces 10*a*. The four heads 10 are arranged in a sub scanning direction at predetermined pitches and are supported by the casing 1*a* via a head holder 3.

The conveyance mechanism 21 includes (a) belt rollers 6, 7, (b) an endless conveyance belt 8 wound around the rollers 6, 7, (c) a nip roller 4 and a peeling plate 5 respectively disposed on opposite sides (outsides) of the conveyance belt 8, (d) a platen 9 disposed inside the conveyance belt 8, and so on. The belt roller 7 is a drive roller that is rotated in a clockwise direction in FIG. 1 by a conveyance motor (see FIG. 8). The conveyance belt 8 runs or is circulated along bold arrow in FIG. 1 by the rotation of the belt roller 7. The belt roller 6 is a driven roller that is rotated in the clockwise direction in FIG. 1 by the circulation of the conveyance belt 8. The nip roller 4 is disposed so as to face the belt roller 6 and press a recording medium in the form of a sheet P supplied from an upstream guide portion (which will be described below), onto a face 8*a* of the conveyance belt 8. The peeling plate 5 is disposed so as to face the belt roller 7, and peels the sheet P off from the face 8*a* and then guides the sheet P toward a downstream guide portion (which will be described below). The platen 9 is disposed so as to face the ejection faces 10*a* of the respective heads 10 and support an upper loop of the conveyance belt 8 from an inside thereof.

The guide unit includes the upstream guide portion and the downstream guide portion disposed with the conveyance mechanism 21 interposed therebetween. The upstream guide portion includes two guides 27*a*, 27*b* and a pair of conveyance rollers 26. The upstream guide portion connects between the sheet-supply unit lb and the conveyance mechanism 21. The downstream guide portion includes two guides 29*a*, 29*b* and two pairs of conveyance rollers 28. This downstream guide portion connects between the conveyance mechanism 21 and the sheet-discharge portion 31.

The sheet-supply unit 1*b* includes a sheet-supply tray 23 and a sheet-supply roller 25. The sheet-supply tray 23 is mountable on and removable from the casing la. The sheet-supply tray 23 has a box-like shape opening upward so as to accommodate various sizes of the sheet P. The sheet-supply roller 25 is rotated to supply an uppermost one of the sheets P in the sheet-supply tray 23 toward the upstream guide portion.

The controller 1*p* configured to control operations of components of the printer 1 to control an overall operation of the printer 1.

In order to record an image on the sheet P on the basis of image data supplied from an external device such as a PC connected to the printer 1, the controller 1*p* controls: a preliminary operation for the recording; the supplying, conveying, and discharging of the sheet P; an ink ejecting operation synchronized with the conveyance of the sheet P; and other operations for the recording. Specifically, on the basis of a recording command received from the external device, the controller 1*p* controls driving devices for driving: a sheet-supply motor 125 (see FIG. 8) for the sheet-supply roller 25; a conveyance motor 127 (see FIG. 8) for the conveyance rollers of the guide portions; the conveyance motor 121 (see FIG. 8), the heads 10; and so on. The sheet P supplied from the sheet-supply tray 23 is conveyed to the conveyance mechanism 21 by the conveyance rollers 26. When the sheet P passes through a position just under the heads 10 in the sub-scanning direction, the heads 10 respectively eject inks of respective colors to form a color image on the sheet P. The ink ejecting operation for the recording is performed on the basis of a detection signal transmitted from a sheet sensor 32 for sensing a leading end of the sheet P. The sheet P is then peeled off from the peeling plate 5 and conveyed upward by the two conveyance rollers 28. Further, the sheet P is discharged onto the sheet-discharge portion 31 through an opening 30 formed in an upper portion of the printer 1.

Here, the sub-scanning direction is a direction parallel to a direction (a part of a conveyance direction) in which the sheet P conveyed by the conveyance mechanism 21 is conveyed through the position just under the heads 10, and the main scanning direction is a direction parallel to a horizontal plane and perpendicular to the sub-scanning direction.

In the space C, a cartridge unit 1*c* is disposed so as to be mountable on and removable from the casing 1*a*. The cartridge unit 1*c* includes a tray 35 and four cartridges 39 accommodated in the tray 35 side by side. The cartridges 39 respectively store the inks of four colors and respectively communicate with the heads 10 via tubes, not shown. The inks stored in the respective cartridges 39 are supplied to the respective heads 10 at appropriate timings.

There will be next explained the construction of each head 10 in detail. It is noted that, since the four heads 10 have the same construction, the following explanation will be given for one of the heads 10 for the sake of simplicity.

The head 10 is a stacked body including: a reservoir unit 11 and a channel unit 12 (see FIG. 6); eight actuator units 17 (see FIG. 2) fixed to an upper face 12*x* of the channel unit 12; Flexible Printed Circuits (FPCs, see FIG. 4) 19 bonded to the respective actuator units 17; and so on which are stacked in an upward and downward direction. The reservoir unit 11 has a channel including a reservoir for temporarily storing the ink supplied from the cartridge 39 (see FIG. 1). The channel unit 12 has channels each extending from a corresponding one of openings 12*y* (see FIG. 2) formed in the upper face 12*x* to a corresponding one of ejection openings 14*a* formed in the lower face (the ejection face 10*a*). Each of the actuator units 17 has piezoelectric actuators respectively for the ejection openings 14*a*.

Projections and recesses are formed on and in a lower face of the reservoir unit 11. The projections are bonded to areas of the upper face 12*x* of the channel unit 12 on which the actuator units 17 are not disposed (i.e., areas including the openings 12*y* and enclosed by two-dot chain lines in FIG. 2). A distal end face of each of the projections has an opening connected to the reservoir and opposed to a corresponding one of the openings 12*y* of the channel unit 12. As a result, individual channels 14 and the reservoir are communicated with each other via the above-described openings. The recesses are opposed to the upper face 12*x* of the channel unit 12, surfaces of the actuator units 17, and surfaces of the FPCs 19 with slight clearances therebetween.

Figure 2:
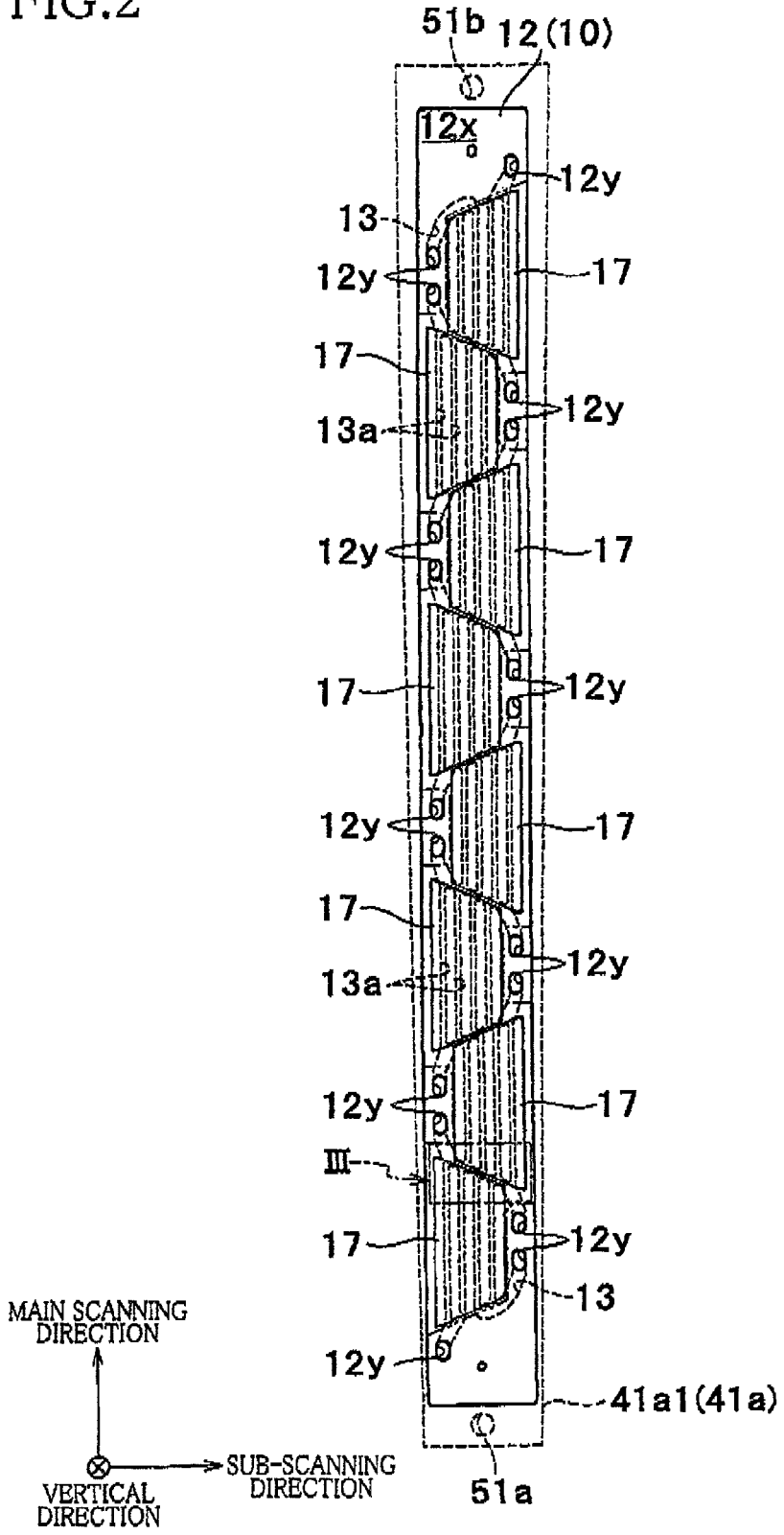
FIG. 2 is a plan view showing a channel unit and actuator units of each ink-jet head of the printer in FIG. 1.
Figure 3:
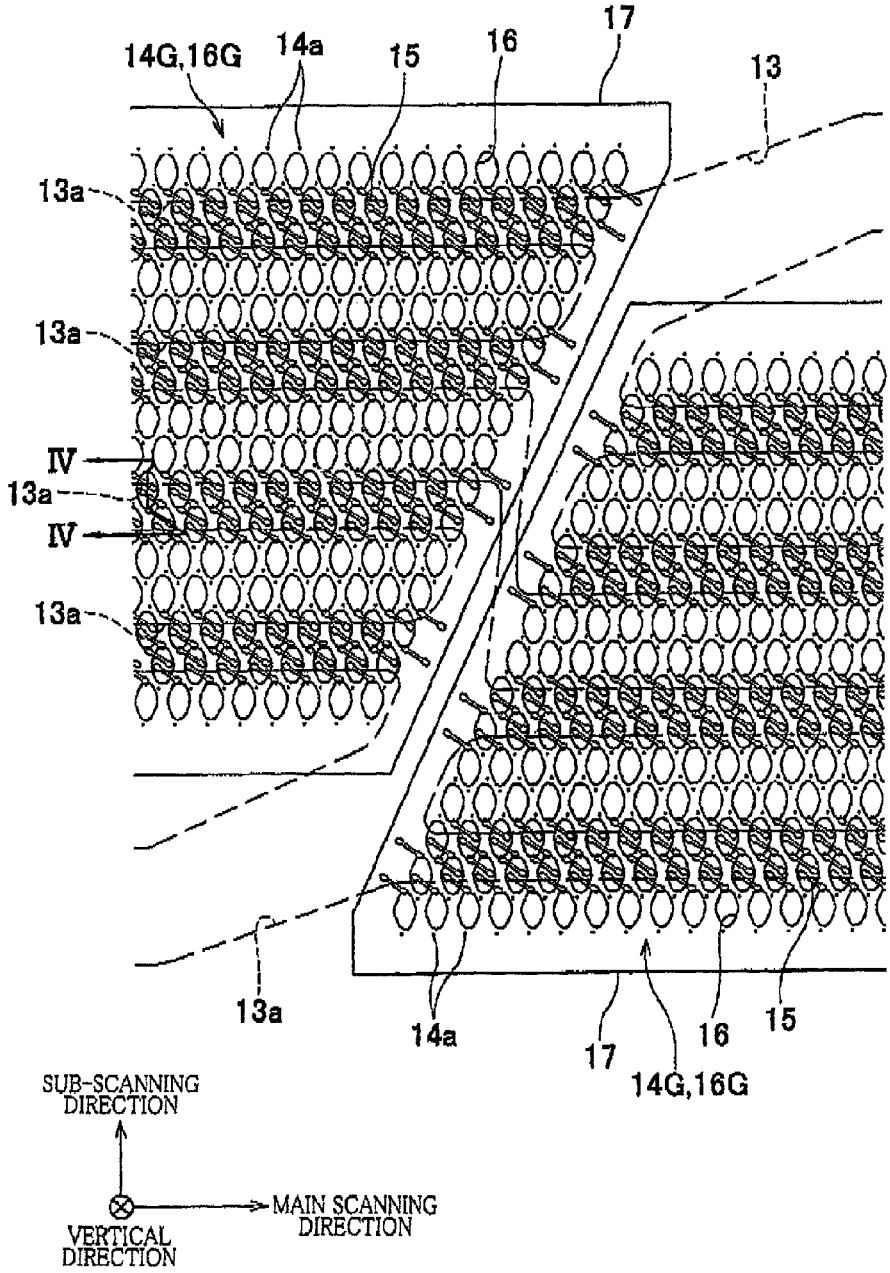
FIG. 3 is an enlarged view showing an area III enclosed by one-dot chain line in FIG. 2.
Figure 4:
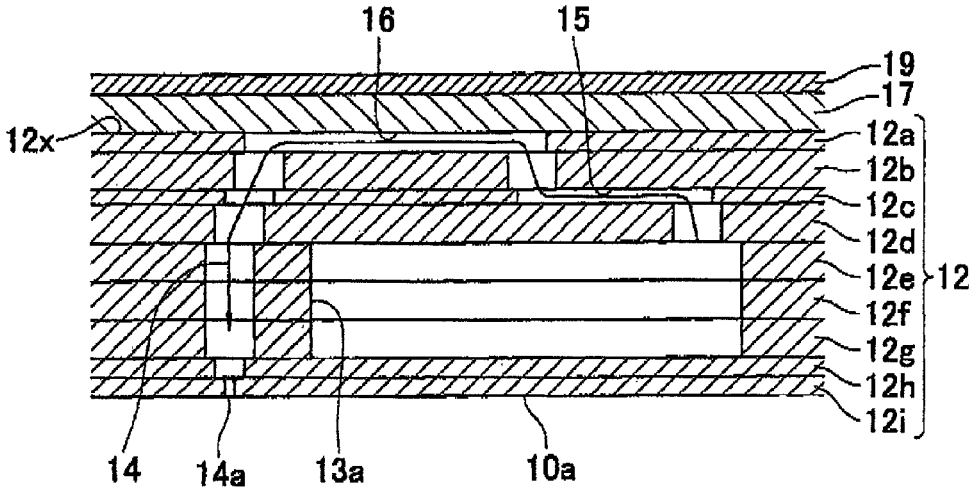
FIG. 4 is a partial cross-sectional view taken along line IV-IV in FIG. 3.

The channel unit 12 is a stacked body constituted by nine metal rectangular plates 12*a*-12*i* (see FIG. 4) having generally the same size and bonded to one another. As shown in FIGS. 2, 3, and 4, the channels of the channel unit 12 include (a) manifold channels 13 respectively having the openings 12*y* at respective one ends, (b) sub-manifold channels 13*a* each branched from a corresponding one of the manifold channels 13, and (c) the individual channels 14 each extending from an outlet of a corresponding one of the sub-manifold channels 13*a* to a corresponding one of the ejection openings 14*a* via a corresponding one of pressure chambers 16. As shown in FIG. 4, each of the individual channels 14 is formed for a corresponding one of the ejection openings 14*a* so as to have an aperture 15 functioning as a restrictor for adjusting a channel resistance. In areas of the upper face 12*x* to which the respective actuator units 17 are bonded, generally rhombic openings respectively for exposing the pressure chambers 16 are formed so as to be arranged in matrix. In areas of the lower face (the ejection face 10*a*) which are respectively opposed to the areas to which the respective actuator units 17 are bonded, the ejection openings 14*a* are formed in matrix in the same pattern as that of the pressure chambers 16. That is, as shown in FIG. 3, pressure-chamber groups 16G each constituted by a multiplicity of the pressure chambers 16 arranged in matrix are formed in the upper face 12*x* of the channel unit 12 so as to be opposed to the respective actuator units 17, and ejection-opening groups 140 each constituted by a multiplicity of the ejection openings 14*a* arranged in matrix are formed in the lower face (the ejection face 10*a*) of the channel unit 12 so as to be opposed to the respective actuator units 17. In correspondence with the actuator units 17, the eight pressure-chamber groups 160 and the eight ejection-opening groups 140 are formed.

It is noted that, in FIG. 3, the pressure chambers 16 and the apertures 15 are illustrated by solid lines for easier understanding purposes though these elements are located under the actuator units 17 and thus should be illustrated by broken lines.

As shown in FIG. 2, the actuator units 17 each having a trapezoid shape in plan view are arranged on the upper face 12*x* in two arrays in a staggered configuration. As shown in FIG. 3, each of the actuator units 17 covers the openings of the pressure chambers 16 formed in the area to which the actuator unit 17 is bonded. That is, each actuator unit 17 covers the openings of all the pressure chambers 16 in the corresponding one of the pressure-chamber groups 16G. Though not shown in any figures, the actuator unit 17 includes a plurality of piezoelectric layers, a vibration plate, a common electrode, and individual electrodes. Each of the piezoelectric layers, the vibration plate, and the common electrode has a trapezoid shape so as to define an outer shape of the actuator unit 17. The individual electrodes are provided respectively for the pressure chambers 16 and each disposed on an upper face of the piezoelectric layer so as to be opposed to a corresponding one of the pressure chambers 16. The vibration plate is disposed between the common electrode and the channel unit 12. Portions of the actuator unit 17 which correspond to the respective individual electrodes function as piezoelectric actuators. That is, in each actuator unit 17, the piezoelectric actuators are provided respectively for all the ejection openings 14*a* in the corresponding ejection-opening group 14G Each actuator of the actuator unit 17 is independently deformable by a voltage applied via the FPC 19. The deformation of each actuator changes a volume of the corresponding pressure chamber 16, which applies an energy to the ink in the pressure chamber 16. Where a magnitude of the energy is equal to or greater than a threshold, the ink is ejected from the ejection opening 14*a*. Where the magnitude of the energy is less than the threshold, a meniscus of the ink formed in the ejection opening 14*a*, is vibrated without the ink ejection from the ejection opening 14*a*.

Each of the FPCs 19 has wirings respectively corresponding to the electrodes of the actuator unit 17, and driver ICs, not shown, are mounted on the wirings. One end of the FPC 19 is fixed to the actuator unit 17, and the other end thereof is fixed to a control board, not shown, of the head 10 (which is disposed on an upper side of the reservoir unit 11). Under the control of the controller 1*p* (see FIG. 1), the FPC 19 sends the driver ICs various drive signals outputted from the control board and sends the actuator units 17 signals produced by the driver ICs.

There will be next explained a construction of the head holder 3.

Figure 5:
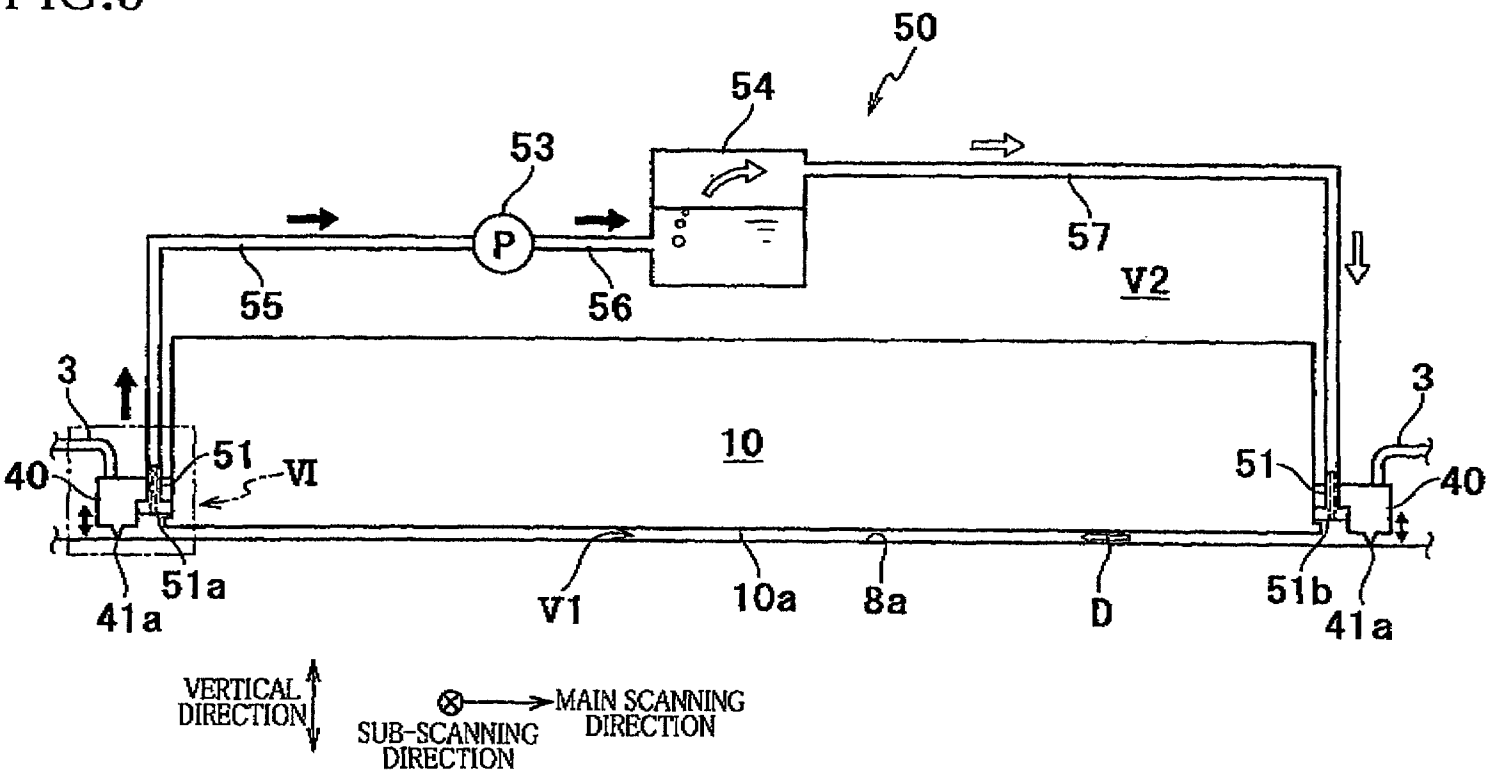
FIG. 5 is a schematic view showing a head holder and a humidifying mechanism of the printer.

The head holder 3 is a frame made of a metal, for example. As shown in FIGS. 1 and 5, a cap unit 40 and a pair of joints 51 are mounted on the head holder 3 for each head 10.

As shown in FIG. 5, the pair of the joints 51 respectively constitute one and the other ends of a circulation channel of the humidifying mechanism 50 and are respectively disposed near one and the other ends of the head 10 in a longitudinal direction thereof. In the humidifying maintenance, an air is sucked or collected through an opening 51*a* (left opening in FIG. 5) formed in a lower face of one of the pair of the joints 51, and a humid air is supplied through an opening 51*b* (right opening in FIG. 5) formed in a lower face of the other of the pair of the joints 51.

Figure 6:
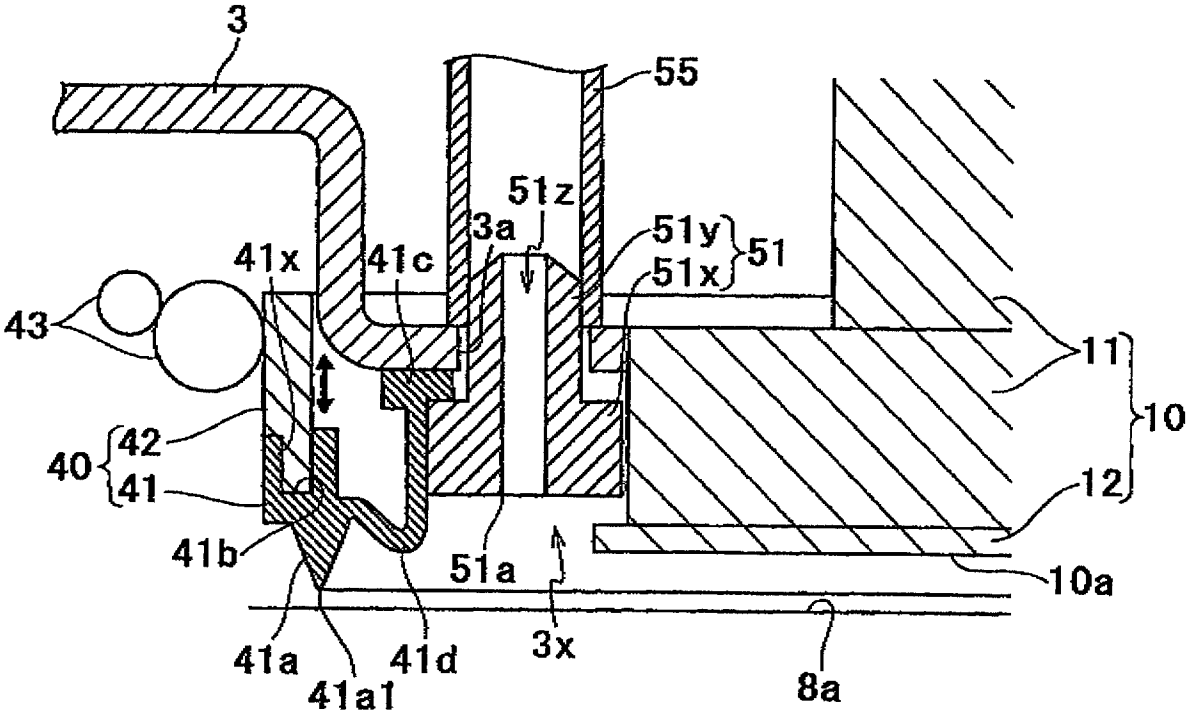
FIG. 6 is a partial cross-sectional view showing an area VI enclosed with a one-dot chain line in FIG. 5.

As shown in FIG. 6, each of the joints 51 has a generally cylindrical shape and has a basal end portion 51*x*, a distal end portion 51*y* extending from the basal end portion 51*x*, and a hollow space 51*z* is formed through the basal end portion 51*x* and the distal end portion 51*y*. The joints 51 are secured to the head holder 3 in a state in which the distal ends 51*y* are fitted through respective through holes 3*a* of the head holder 3.

The cap unit 40 as one element of a sealing mechanism has an annular shape in plan view for enclosing an outer peripheral area of the ejection face 10*a*. As shown in FIG. 6, the cap unit 40 includes: an elastic member 41 supported by the head holder 3 via a fixed portion 41*c*; and a movable member 42 movable upward and downward.

The elastic member 41 is formed of an elastic material such as a rubber and includes (a) a base portion 41*x*, (b) a projecting portion 41*a* projecting downward from a lower face of the base portion 41*x* so as to have an inverted triangle shape in cross section, (c) the fixed portion 41*c* having a T-shape in cross section and fixed to the head holder 3, and (d) a connecting portion 41*d* for connecting the base portion 41*x* and the fixed portion 41*c* to each other. The elastic member 41 has an annular shape in plan view for enclosing the outer peripheral area of the ejection face 10*a*. An upper end portion of the fixed portion 41*c* is fixed to the head holder 3 by adhesive, for example. The fixed portion 41*c* is sandwiched near the through hole 3*a* between the head holder 3 and the basal end portion 51*x* of the joint 51. The connecting portion 41*d* extends from a lower end of the fixed portion 41*c* and curves to an outside in a direction away from the ejection face 10*a* in plan view, so as to be connected to a lower end of the base portion 41*x*. The connecting portion 41*d* is can be deformed by the upward and downward movement of the movable member 42. An upper face of the base portion 41*x* has a recessed portion 41*b* that is fitted on a lower end of the movable member 42.

The movable member 42 is formed of a rigid material and has an annular shape in plan view for enclosing an outer peripheral area of the ejection face 10*a* of the head 10 like the elastic member 41. The movable member 42 is supported by the head holder 3 via the elastic member 41 so as to be movable relative to the head holder 3 in the vertical direction. Specifically, the movable member 42 is connected to a plurality of gears 43 and moved upward and downward by the gears 43 rotated by a drive power outputted from a cap up-down motor 140 under the control of the controller 1*p*. In this upward and downward movement of the movable member 42, the base portion 41*x* is also moved upward and downward with the movable member 42 because the lower end of the movable member 42 is fitted in the recessed portion 41*b* of the elastic member 41. When the movable member 42 is moved upward and downward, the projecting portion 41*a* is also moved upward and downward in the state in which the fixed portion 41*c* is fixed to the head holder 3. As a result, a position of a distal end 41*a*1 of the projecting portion 41*a* relative to the ejection face 10*a* in the vertical direction is changed.

According to the upward and downward movement of the movable member 42, the projecting portion 41*a* is selectively positioned at a contact position (see FIG. 5) at which the distal end 41*a*1 is held in contact with the face 8*a* of the conveyance belt 8 and at a distant position (see FIG. 6) at which the distal end 41*a*1 is distant from the face 8*a* of the conveyance belt 8. As shown in FIG. 5, when the projecting portion 41*a* is positioned at the contact position, an ejection space V1 formed between the ejection face 10*a* and the face 8*a* is sealed from an outside space V2 so as to be isolated from or not communicate with the outside space V2. This state of the cap unit 40 may be hereinafter referred to as "sealing state" or "capping state". As shown in FIG. 6, when the projecting portion 41*a* is positioned at the distant position, the ejection space V1 is not sealed from the outside space V2 (that is, the ejection space V1 communicates with the outside space V2). This state of the cap unit 40 may be hereinafter referred to as "unsealing state" or "uncapping state". The controller 1*p* controls the components to establish the sealing state of the cap unit 40 where the recording has not been performed for a relative long time, for example.

There will be next explained a construction of the humidifying mechanism 50.

Figure 7:
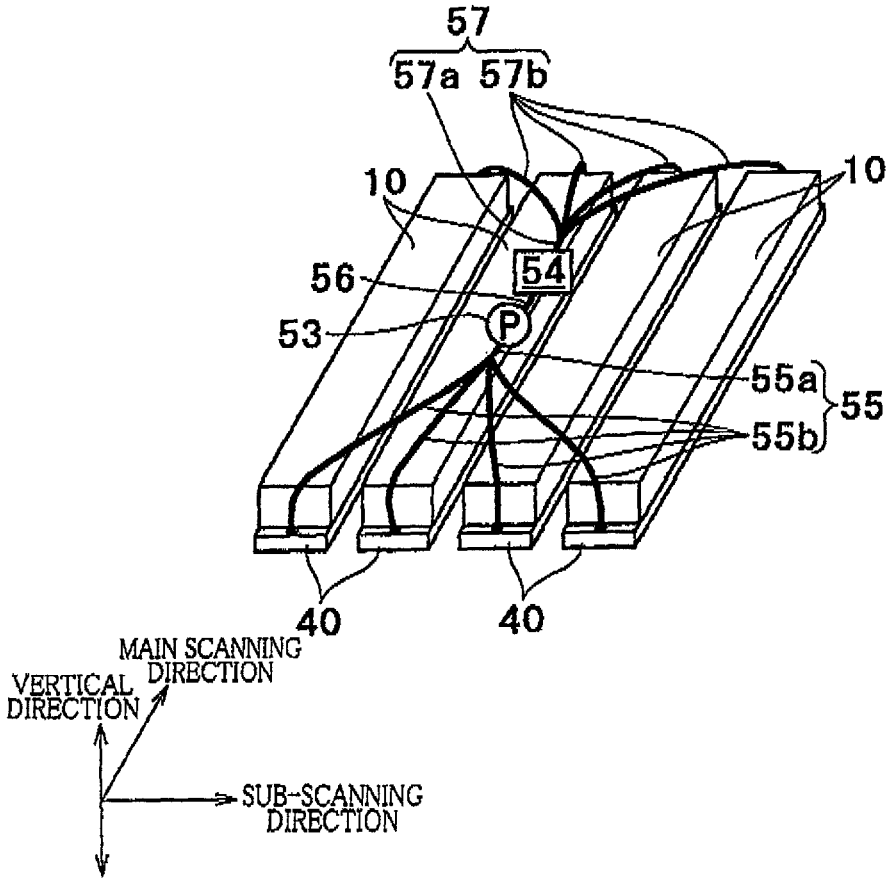
FIG. 7 is a schematic view showing connection between four heads and the humidifying mechanism of the printer.

As shown in FIG. 5, the humidifying mechanism 50 as one example of a humid-air supply mechanism includes the joints 51, tubes 55, 56, 57, a humidification pump 53, and a tank 54. Although the pair of the joints 51 are provided for each head 10, as shown in FIG. 7, the single humidification pump 53 and the single tank 54 are provided in the printer 1, that is, the single humidification pump 53 and the single tank 54 are provided for the four heads 10. The tube 55 includes a main portion 55*a* common for the four heads 10 and four branch portions 55*b* branched from the main portion 55*a* and each extending to a corresponding one of the joints 51. Likewise, the tube 57 includes a main portion 57*a* common for the four heads 10 and four branch portions 57*b* branched from the main portion 57*a* and each extending to a corresponding one of the joints 51.

One ends of the tube 55 (distal ends of the respective branch portions 55*b*) are respectively fitted on the distal end portions 51*y* of the joints 51 (left joints 51 in FIG. 5) provided on the respective heads 10. The other end of the tube 55 (an end of the main portion 55*a* opposite to the branch portions 55*b*) is connected to the humidification pump 53. That is, the tube 55 communicably connects the humidification pump 53 and the hollow space 51*z* of one of each pair of the joints 51 to each other. The tube 56 communicably connects the humidification pump 53 and the tank 54 to each other. One ends of the tube 57 (distal ends of the respective branch portions 57*b*) are respectively fitted on the distal end portions 51*y* of the joints 51 (right joints 51 in FIG. 5) provided on the respective heads 10. The other end of the tube 57 (an end of the main portion 57*a* opposite to the branch portions 57*b*) is connected to the tank 54. That is, the tube 57 communicably connects the tank 54 and the hollow space 51*z* of the other of each pair of the joints 51 to each other.

The tank 54 stores water in its lower space and stores in its upper space the humid air humidified by the water stored in the lower space. The tube 56 communicates with the lower space of the tank 54. The tube 57 communicates with the upper space of the tank 54. It is noted that a check valve, not shown, is provided on the tube 56 for preventing the water in the tank 54 from flowing into the humidification pump 53, resulting in that the air flows only in a direction indicated by arrows in FIG. 5.

Figure 8:
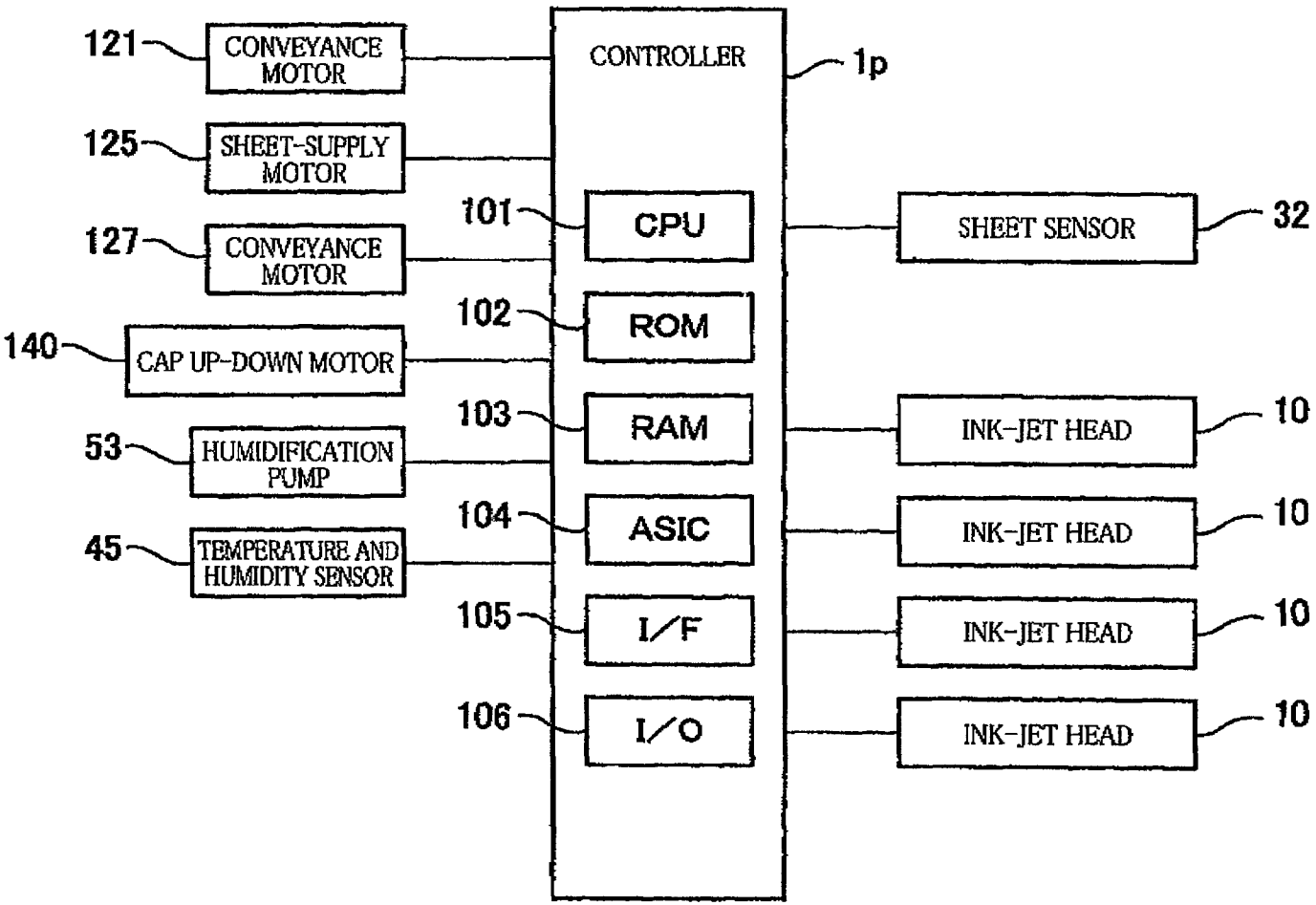
FIG. 8 is a block diagram showing an electric configuration of the printer.

There will be next explained an electric configuration of the printer 1 with reference to FIG. 8.

The controller 1*p* includes a Central Processing Unit (CPU) 101, a Read Only Memory (ROM) 102, a Random Access Memory (RAM) 103 such as a nonvolatile RAM, an Application Specific Integrated Circuit (ASIC) 104, an interface (I/F) 105, an Input/Output Port (I/O) 106, and so on. The ROM 102 stores therein programs executed by the CPU 101, various fixed data, and so on. The RAM 103 temporarily stores therein data required for the execution of the programs, such as image data based on which an image is to be formed on the sheet P. The ASIC 104 performs, e.g., rewriting and sorting of the image data. Specifically, the ASIC 104 performs a signal processing and an image processing, for example. The I/F 105 transmits or receives data to or from the external device. The I/O 106 inputs or outputs detection signals of various sensors.

The controller 1*p* is connected to the motors 121, 125, 127, 140, the humidification pump 53, temperature and humidity sensors 45, the sheet sensor 32, the control boards of the respective heads 10, and other components. Each of the temperature and humidity sensors 45 is for sensing or detecting a temperature and a humidity in a corresponding one of the ejection spaces V1 and provided in a corresponding one of the cap units 40 (on a face thereof opposed to the ejection space V1) or near an outer peripheral portion of the ejection face 10*a* of a corresponding one of the heads 10.

Figure 9:
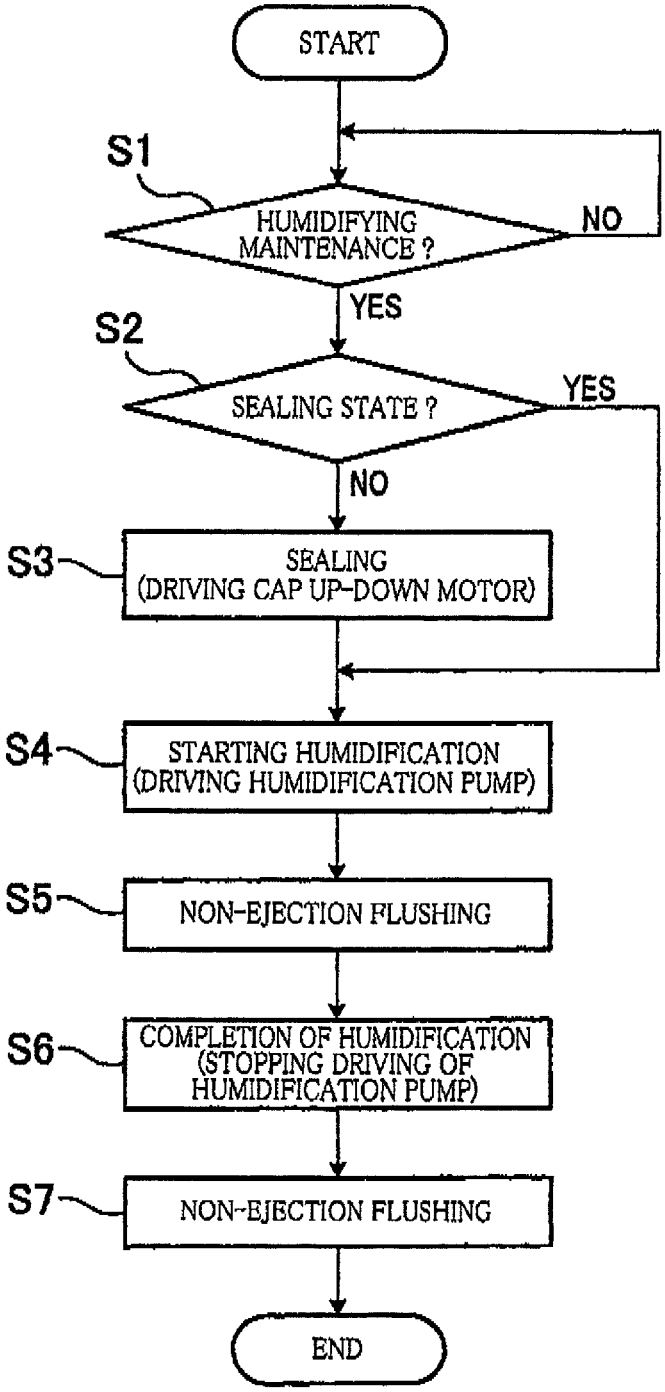
FIG. 9 is a flow-chart showing a program to be executed by the controller in the humidifying maintenance.

There will be next explained a program executed by the controller 1*p* in the humidifying maintenance with reference to FIG. 9. The following processings are executed by the CPU 101 in accordance with the program stored in the ROM 102. It is noted that the following explanation will be also given for one of the heads 10 for the sake of simplicity.

First, the controller 1*p* in S1 judges whether the humidifying maintenance is to be performed or not. The controller 1*p* judges that the humidifying maintenance is to be performed (S1: YES) in the following cases: when a predetermined length of time has passed from a completion of the recording (that is, where the unsealing state is continued and no recording is planned); when the cap unit 40 is kept in the sealing state for a relatively long time; when the cap unit 40 is kept in the unsealing state for a relatively long time due to an operation for clearing a sheet jamming, for example; and where one or ones of the ejection openings 14*a* are not used in the ink ejection for recording an image on a sheet having a relatively small length in the main scanning direction (e.g., a postcard), for example.

Then in S2, the controller 1*p* judges whether the cap unit 40 is in the sealing state or not on the basis of, e.g., an encoder of the cap up-down motor 140. Where the controller 1*p* has judged that the cap unit 40 is in the sealing state (S2: YES), the controller 1*p* goes to S4. Where the controller 1*p* has judged that the cap unit 40 is not in the sealing state (that is, the cap unit 40 is in the unsealing state) (S2: NO), the controller 1*p* in S3 controls the cap up-down motor 140 to lower the movable member 42 to change the state of the cap unit 40 from the unsealing state to the sealing state. The controller 1*p* then goes to S4.

In S4, the controller 1*p* controls the humidification pump 53 to start the humidification. When the humidification pump 53 is driven, the air in the ejection space V1 is sucked through the opening 51*a* of the one of the joints 51. The air sucked through the opening 51*a* is then moved to the humidification pump 53 through the hollow space 51*z* and the tube 55 to be supplied to the lower space of the tank 54 (beneath a water surface) through the tube 56. The air humidified by the water in the tank 54 is discharged from the upper space of the tank 54 and passes through the tube 57 to be supplied into the ejection space V1 through the opening 51*b* of the other of the joints 51. In FIG. 5, boldface (black) arrows indicate the flow of the air before the humidification, and outline (white) arrows indicate the flow of the air after the humidification. This humidification (the supply of the humid air into the ejection space V1) increases a humidity in the ejection space V1. This suppresses a rise of an ink viscosity due to vaporization of water (water content) in the ink in the head 10 (especially in the ejection openings 14*a*), making it possible to prevent problems such as a clogging of the ejection openings 14*a*. Further, the water (water content) is supplied to the ink in the ejection openings 14*a* by the humidification. Thus, even where the viscosity of the ink in the head 10 (especially in the ejection openings 14*a*) has been already relatively high, the viscosity of the ink in the ejection opening 14*a* can be lowered so as to fall within a proper range. In the humidification, a temperature of the humid air, a supply amount of the humid air per unit time, and the like are controlled such that the humidity in the ejection space V1 becomes a predetermined humidity. The temperature of the humid air may be controlled by a heater, not shown, that heats the water stored in the tank 54, for example. The supply amount of the humid air per unit time may be controlled by an amount of rotations of the humidification pump 53, for example. Further, a result of the detection of the temperature and humidity sensor 45 may be used for the humidification control. The predetermined humidity is a humidity when the viscosity of the ink in the head is within the proper range in a image quality. That is, the predetermined humidity is a humidity when the ink can be stably ejected from the ejection openings 14*a*. It is noted that only a lower limit value of the humidity (that corresponds to an upper limit value of the above-described proper range of the viscosity and that is about 85%, for example) may be set to control the humidification such that the humidity in the ejection space V1 is higher than the lower limit value.

After S4, when a second predetermined time or second period (a first predetermined time is explained later) has passed from the start of the driving of the humidification pump 53 in S4, the controller 1*p* in S5 starts a non-ejection flushing. Here, the non-ejection flushing is a meniscus vibrating operation in which a meniscus of the ink formed in the ejection opening 14*a* is vibrated without ejection of the ink from the ejection opening 14*a*. In this operation, the actuator of the actuator unit 17 is driven by the application of the pulse voltage. A magnitude and a voltage of the pulse voltage may be any value as long as the meniscus of the ink formed in the ejection opening 14*a* is vibrated without the ejection of the ink from the ejection opening 14*a*.

For example, the controller 1*p* determines the second predetermined time in S4 (at the start of the humidification) on the basis of the humidity and the temperature in the ejection space V1 and an elapsed time from the last recording (i.e., the last ink ejection from the ejection openings 14*a*). The humidity and the temperature in the ejection space V1 are detected on the basis of the signal outputted from the temperature and humidity sensor 45. Where the humidity and the temperature in the ejection space V1 becomes equal to or higher than a predetermined value and where the above-described elapsed time becomes equal to or longer than a predetermined length of time, it is estimated that the viscosity of the ink in the ejection openings 14*a* have been sufficiently lowered. The second predetermined time is set such that the higher the viscosity of the ink in the ejection opening 14*a*, the longer the second predetermined time is. For example, the lower the humidity in the ejection space V1 in the unsealing state, and the higher the temperature in the ejection space V1 in the unsealing state, and the longer the elapsed time from the last recording, the longer the second predetermined time is set. In the present embodiment, the ROM 102 stores therein a table representing a relationship between the second predetermined time and the humidity and temperature in the ejection space V1, the above-described elapsed time, and the like at the start of the humidification, and the controller 1*p* reads the table to determine the second predetermined time.

In S5, the controller 1*p* adjusts the second predetermined time by controlling the eight actuator units 17 individually in order from a most-upstream-side actuator unit 17 so as to start the non-ejection flushing for the ejection openings 14*a* in order from a most-upstream-side opening 14*a* in a direction indicated by arrow D in FIG. 5 (i.e., a direction of the flow of the humid air supplied to the ejection space V1). Accordingly, a start timing of the non-ejection flushing is early (in other words, the second predetermined time is short) in the ejection opening 14*a* that corresponds to the actuator unit 17 whose distance to the opening 51*b* is short in the main scanning direction. In other words, the nearer the ejection opening 14*a* to the opening 51*b* in the main scanning direction, the earlier the non-ejection flushing is performed for the ejection opening 14*a*. The nearer to the opening 51*b*, the higher the humidity in the ejection space V1 after the passage of the second predetermined time from the start of the humidification is. The viscosity of the ink in the ejection openings in the unit 17 near to the opening 51*b* is lower than that in the ejection openings in the unit 17 far from the opening 51*b*. Thus, the controller 1*p* adjusts the second predetermined time so as to start the non-ejection flushing in order from the most-upstream-side unit 17 in the direction of the flow of the humid air. Further, the controller 1*p* adjusts the second predetermined time on the basis of the second predetermined time determined in 84, for each of the plurality of ejection openings 14*a* which corresponds to one of the actuator units 17. Specifically, the controller 1*p* adjusts the second predetermined time such that the higher the viscosity of the ink in the ejection opening 14*a*, the longer the second predetermined time is (in other words, the later the start timing of the non-ejection flushing is). It is possible to consider that the viscosity of the ink in the ejection opening 14*a* is proportional to the time elapsed from the last ejection of the ink from the ejection opening 14*a*. Thus, the controller 1*p* sets the second predetermined time for the ejection opening 14*a* such that the longer the above-described elapsed time, the longer the second predetermined time is. For example, the controller 1*p* adjusts the second predetermined time for the ejection openings 14*a* in one unit 17 such that, the longer a time elapsed from the last ejection, the longer the second predetermined time is. In this ease, the non-ejection flushing is started for low-viscosity nozzles (the ejection openings 14*a* in which the viscosity of the ink is relatively low) during the humidification for high-viscosity nozzles (the ejection openings 14*a* in which the viscosity of the ink is relatively high).

The controller 1*p* is configured to determine a length of time of the non-ejection flushing for each of the plurality of ejection openings 14*a* such that the higher the viscosity of the ink in the ejection opening 14*a*, the longer the length of time of the non-ejection flushing. The length of time of the non-ejection flushing is a time during which the pulse voltage for the non-ejection flushing is applied to the actuator in a period from S4 (the start of the humidification) to S6 (a completion of the humidification). It is possible to consider that the viscosity of the ink in the ejection opening 14*a* is proportional to the time elapsed from the last ejection of the ink from the ejection opening 14*a*. Thus, the controller 1*p* sets the length of time of the non-ejection flushing for the ejection opening 14*a* such that the longer the above-described elapsed time, the longer the length of time of the non-ejection flushing is.

It is noted that, the controller 1*p* sets the length of time of the non-ejection flushing at zero, that is, the controller 1*p* determines not to perform the non-ejection flushing for (i) the ejection opening(s) 14*a* in each of which the viscosity of the ink in the ejection opening 14*a* is lower than a threshold (a lower limit value of the above-described proper range of the viscosity) and (ii) the ejection opening(s) 14*a* not to be used for the ink ejection in the image recording on the sheet P.

Further, the controller 1*p* determines the length of time of the non-ejection flushing for each of the ejection openings 14*a* and performs the non-ejection flushing intermittently for the ejection opening(s) 14*a* in which the length of time of the non-ejection flushing is longer than a third predetermined time or third period that is a length of time which may cause a malfunction due to an increase in a temperature of the driver IC, for example. That is, the controller 1*p* applies the pulse voltage for the non-ejection flushing to the actuator not continuously but intermittently.

At the start timing of the non-ejection flushing, a moisture content of the ink located at an opening portion of the ejection opening 14*a* is preferably higher than a moisture content of the ink in the ejection opening 14*a*. Further, at the completion timing of the non-ejection flushing, water (water content) whose amount is equal to or greater than an amount of water vaporized via the ejection opening 14*a* has preferably been sucked into the head 10.

After S5, the controller 1*p* in S6 stops the driving of the humidification pump 53 to complete the humidification. Then in S7, the controller 1*p* performs the non-ejection flushing that is the same as the non-ejection flushing in S5, in a period that extends for the first predetermined time or first period from the completion of the humidification in S6 (i.e., from the stop of the driving of the humidification pump 53). In S7, the controller 1*p* executes the controls that are the same as those in S5, that is, the controller 1*p* drives the eight actuator units 17 individually; performs the non-ejection flushing intermittently for the ejection opening(s) 14*a* in which the length of time of the non-ejection flushing is longer than the third predetermined time; determines the length of time of the non-ejection flushing for each of the ejection openings 14*a* such that the higher the viscosity of the ink in the ejection opening 14*a*, the longer the length of time of the non-ejection flushing is; and determines not to perform the non-ejection flushing for (i) the ejection opening(s) 14*a* in each of which the viscosity of the ink in the ejection opening 14*a* is lower than the threshold and (ii) the ejection opening(s) 14*a* not to be used for the ink ejection in the image recording on the sheet P. After S7, the controller 1*p* completes this routine.

As described above, in the printer 1, the controller 1*p*, and the storage medium storing the program in the present embodiment, the ink in the head 10 is agitated by performing the non-ejection flushing (S5, S7) (i) in a humidification period which extends from S4 to S6 in which the humidifying mechanism 50 performs the humidification for the ejection space V1 in the present embodiment (that is, in which the humidification pump 53 is being driven) and (ii) in a post-humidification period that extends for the first predetermined time from the completion of the humidification of the ejection space V1 by the humidifying mechanism 50 in the present embodiment (i.e., from the stop of the driving of the humidification pump 53 in S6). Thus, the ink in the ejection opening 14*a* whose viscosity has been lowered in the humidification moves toward an upstream side thereof in a direction of the flow of the ink in the head 10 when the ink is ejected from the ejection opening 14*a*, and the ink located on an upstream side moves toward the ejection opening 14*a*. Accordingly, using both of the humidification and the non-ejection flushing enables the viscosity of the ink in the head to speedily fall within the proper range while suppressing an amount of waste ink. It is noted that one example of the first predetermined time is a length of time (period) in which the humidity in the ejection space V1 after the humidification is higher than an equilibrium humidity of the ink in the ejection opening 14*a*.

The controller 1*p* starts the non-ejection flushing in S5 when the second predetermined time has passed from the start of the driving of the humidification pump 53 in the humidification period. Where the non-ejection flushing is started just after the humidification is started, the ink in the ejection opening 14*a* may move toward an upstream side thereof in a state in which the viscosity of the ink has not been lowered sufficiently, making it impossible to efficiently make the viscosity of the ink in the head fall within the proper range. In this case, there is a need to lengthen an agitation time by the non-ejection flushing, resulting in an increase in a power consumption. In order to solve this problem, this printer 1 is configured such that the non-ejection flushing is started when the second predetermined time has passed from the start of the humidification as described above, making it possible to reduce the above-described problem that an efficiency of viscosity adjustment is reduced, causing the increase in the power consumption. Further, this printer 1 is configured such that the non-ejection flushing is performed in the period until the first period has passed from the stop of the driving of the humidification pump 53 (S6). This makes it possible to perform the agitation by the non-ejection flushing before the viscosity of the ink in the ejection opening 14*a* has risen after the completion of the humidification, thereby efficiently making the viscosity of the ink in the head fall within the proper range.

The controller 1*p* determines the second predetermined time on the basis of the humidity in the ejection space V1, the temperature in the ejection space V1, and the elapsed time from the last ejection of the ink from the ejection openings 14*a*. Thus, the second predetermined time can be appropriately determined, thereby reliably reducing the above-described problem that the efficiency of the viscosity adjustment is reduced, causing the increase in the power consumption.

The controller 1*p* determines the second predetermined time for each of the ejection openings 14*a* such that the higher the viscosity of the ink in the ejection opening 14; the longer the second predetermined time is. As thus described, the higher the viscosity of the ink in the ejection opening 14; the longer the second predetermined time is made, and the viscosity of the ink is lowered by the humidification. As a result, it is possible to suppress variation of the viscosity of the ink in the ejection openings 14*a*. That is, the viscosity of the ink can be adjusted so as to fall within the proper range for all the ejection openings 14*a*. This printer 1 may be configured such that different second predetermined times are used among the ejection openings 14*a*. In this configuration, the start timings of the non-ejection flushing are deviated from one another among the ejection openings 14*a*, making it possible to suppress the maximum power consumption.

The controller 1*p* determines the length of time of the non-ejection flushing for each of the ejection openings 14*a* such that the higher the viscosity of the ink in the ejection opening 14*a*, the longer the length of time of the non-ejection flushing is. As thus described, the higher the viscosity of the ink in the ejection opening 14*a*, the longer the length of time of the non-ejection flushing is made, and the ink in the head 10 is agitated, making it possible to suppress the variation of the viscosity of the ink in the ejection openings 14*a*. That is, the viscosity of the ink can be adjusted so as to fall within the proper range for all the ejection openings 14*a*. Further, the length of time of the non-ejection flushing is relatively short in each ejection opening 14*a* in which the viscosity of the ink is relatively low, thereby suppressing the power consumption.

The controller 1*p* determines not to perform the non-ejection flushing for (i) the ejection opening(s) 14*a* in each of which the viscosity of the ink in the ejection opening 14*a* is lower than the threshold and (ii) the ejection openings) 14*a* not to be used for the ink ejection in the image recording on the sheet P. Thus, it is possible to effectively suppress the power consumption. It is noted that the ejection openings) 14*a* not to be used for the ink ejection in the image recording on the sheet P include: the ejection opening(s) 14*a* each located at a position not opposed to the sheet P where the sheet P having a relatively small length in the main scanning direction is used; and the ejection opening(s) 14*a* in which no ink ejection is planned for the image recording where the printer 1 has received the recording command, for example. Since this printer 1 does not perform the non-ejection flushing for the ejection opening(s) 14*a* from which no ink ejection is planned, it is possible to effectively suppress the power consumption required for the non-ejection flushing.

The controller 1*p* starts the non-ejection flushing for the ejection openings 14*a* in order from an upstream side in the direction of the flow of the humid air supplied to the ejection space V1 by the humidifying mechanism 50. Thus, the non-ejection flushing is started in order from the ejection opening 14*a* in which the viscosity of the ink has been lowered by the humid air, whereby the viscosity of the ink can be adjusted so as to fall within the proper range for all the ejection openings 14*a*. Further, since the start timings of the non-ejection flushing are made different from one another among the ejection openings 14*a*, making it possible to suppress the maximum power consumption.

The controller 1*p* controls the actuator units 17 individually in the non-ejection flushing. Thus, the timings of the non-ejection flushing are different from one another among the ejection-opening groups 14G, thereby efficiently suppressing the maximum power consumption.

The controller 1*p* determines the length of time of the non-ejection flushing for each of the ejection openings 14*a* and performs the non-ejection flushing intermittently for the ejection opening(s) 14*a* in which the length of time of the non-ejection flushing is longer than the third predetermined time. If the non-ejection flushing is continuously performed for a relatively long time, a malfunction may occur due to the increase in the temperature of the driver IC, for example. However, the above-described configuration can suppress the occurrence of the malfunction.

While the embodiment of the present invention has been described above, it is to be understood that the invention is not limited to the details of the illustrated embodiment, but may be embodied with, various changes and modifications, which may occur to those skilled in the art, without departing from the spirit and scope of the invention.

<Non-ejection Flushing>

The non-ejection flushing may be performed not intermittently but continuously for the ejection opening(s) in which the length of time of the non-ejection flushing is longer than the third predetermined time. In the non-ejection flushing, the controller may drive the plurality of actuator units at the same time without driving the plurality of actuator units individually. The non-ejection flushing may be performed for the ejection opening(s) in which the viscosity of the liquid in the ejection opening is less than the threshold and for the ejection opening(s) not to be used for the liquid ejection in the image recording on the recording medium. The start timing of the non-ejection flushing and the length of time of the non-ejection flushing for each of the ejection openings may be determined at any timing and any length of time (for example, the start timings of the non-ejection flushing and/or the lengths of time of the non-ejection flushing may be the same among the ejection openings. Further, the start timing of the non-ejection flushing and/or the length of time of the non-ejection flushing may be determined on the basis of factor(s) other than the viscosity of the liquid in the ejection opening).

In the above-described embodiment, the second predetermined time is determined at the start of the humidification, but the present invention is not limited to this control. For example, the second predetermined time may be determined before the start of the humidification or in the humidification (for example, where the second predetermined time is determined in the humidification, the start timing of the non-ejection flushing may be determined while checking the temperature and the humidity in the ejection space when needed). Further, in the above-described embodiment, the second predetermined time is determined on the basis of all of the humidity in the ejection space, the temperature in the ejection space, and the elapsed time from the last ejection of the liquid from the plurality of ejection openings, but the present invention is not limited to this control. For example, the second predetermined time may be determined on the basis of one or two of the above-described factors. Further, in the above-described embodiment, the second predetermined time is determined on the basis of the above-described factors at the start of the humidification, but the present invention is not limited to this control. For example, the second predetermined time may be determined on the basis of the above-described factors at any timing before the start of the humidification or in the humidification. Further, the above-described factors does not need to be directly used to determine the second predetermined time, but information for estimating the above-described factors such as a driving time of the humidifying mechanism, a temperature and/or a humidity of the humid air, and a temperature and/or a humidity of the outside space may be used to determine the second predetermined time.

The non-ejection flushing may be started just after the humidification is started. The non-ejection flushing only needs to be performed in at least one of the humidification period and the post-humidification period. For example, the non-ejection flushing (S7) performed in the post-humidification period may be omitted. Conditions of the non-ejection flushing may be different between the humidification period and the post-humidification period.

<Liquid Ejection Head>

The liquid ejection head does not need to include the actuator units respectively for the ejection-opening groups (for example, the liquid ejection head may include, for the respective ejection openings, actuators each not expanding over a plurality of the pressure chambers and including the piezoelectric layers, the vibration plate, and the individual electrodes individually for the respective pressure chambers). Any number of the liquid ejection heads may be included in the liquid ejection apparatus.

<Cap Unit >

The gears 43 are used as a mechanism for moving the cap unit 40 in the above-described embodiment, but the present invention is not limited to this configuration. For example, various mechanisms such as a cam mechanism using a solenoid and a link may be used. The cap unit 40 may be unmovable relative to the liquid ejection head. For example, the printer 1 may be configured such that the cap unit 40 is fixed so as to be unmovable relative to the head 10 in a state in which the distal end 41*a*1 is located below the ejection face 10*a* and such that a downward movement of the head 10 or an upward movement of the conveyance belt 8 selectively establishes the sealing state in which the distal end 41 al is held in contact with the face 8*a* of the conveyance belt 8 and the unsealing state in which the distal end 41*a*1 is distant from the face 8*a* of the conveyance belt 8.

The cap unit 40 may be independent of the liquid ejection head. For example, where a cap in the form of a casing opening upward is used as the cap unit 40, the printer 1 may be configured such that the cap is disposed below the ejection face 10*a* and such that the downward movement of the head 10 or an upward movement of the cap selectively establishes the sealing state in which an opening end of the cap is held in contact with the ejection face 10*a* and the unsealing state in which the opening end of the cap is distant from the ejection face 10*a*. In this case, the opening 51*a* and the opening 51*b* may be formed in the cap, and the humidifying mechanism 50 may be provided on a cap side (in FIG. 5, the humidifying mechanism 50 is provided on a head side). Where the non-ejection flushing is performed in the post-humidification period, the cap unit 40 may be in any of the sealing state and the unsealing state.

<Humidifying Mechanism>

In the above-described embodiment, the air is circulated such that the air collected through the opening 51*a* is supplied into the ejection space V1 through the opening 51*b*, but the air does not need to be circulated as long as the humid air is supplied into the ejection space V1. Four humidification pumps 53 and four tanks 54 may be provided respectively for the heads 10, and four tubes 55 and four tubes 57 may be provided respectively for the heads 10. In the above-described embodiment, the humidification pump 53 and the tank 54 are used as the humidifying mechanism, but another mechanism may be used as long as the ejection space can be humidified. For example, only the tank 54 may be used to perform the humidification while the humidification pump 53 is omitted. Further, an ultrasonic humidifier may be used for the humidification. Further, a cloth or a porous material such as a sponge containing water in its circulation channels may be disposed for the humidification. The temperature and humidity sensor 45 and the heater may be omitted.

The present invention is applicable to any of a line printer and a serial printer. Further, the present invention is applicable not only to the printer but also to another liquid ejection apparatus such as a facsimile machine and a copying machine. The present invention is also applicable to a liquid ejection apparatus configured to eject liquid other than the ink.

The recording medium is not limited to the sheet P and may be various recording media such as a cloth.

It is noted that, in the above-described embodiment, the non-ejection flushing (S7) after the completion of the humidification (S6) is performed, with the cap unit 40 being in the sealing state, but this printer 1 may be configured such that the cap unit 40 takes the unsealing state after the completion of the humidification, and the non-ejection flushing is performed in the unsealing state. The cap unit 40 takes the unsealing state when the printer 1 has received the recording command, for example. Also in this unsealing state, the ink in the head 10 can be agitated where the agitation is performed within the first period from the completion of the humidification, making it possible to make the viscosity of the ink in the head fall within the proper range.

Further, a program executed by the CPU 101 in the above-described embodiment may be stored in any storage medium as long as the program is stored in a nonvolatile storage medium. For example, the program may be stored in various computer-readable devices such as various portable discs, various portable flash memories, and various portable hard discs and may be stored in various discs, various flash memories, and various hard discs installed in, e.g., a computer, a printer device, or a server.

What is claimed is:

1. A liquid ejection apparatus comprising:

a liquid ejection head having an ejection face that has a plurality of ejection openings formed therein, the liquid ejection head being configured to eject liquid through the plurality of ejection openings to record an image on a recording medium, and an ejection space being defined so as to face the ejection face;

a sealing mechanism configured to selectively establish (i) a sealing state in which the sealing mechanism seals the ejection space from an outside and (ii) an unsealing state in which the sealing mechanism does not seal the ejection space from the outside;

a humid-air supply mechanism configured to supply, into the ejection space, humid air that has been humidified when the sealing mechanism is in the sealing state; and a controller configured to control the sealing mechanism and the humid-air supply mechanism to humidify the ejection space in a humidification period in which the humid air supply mechanism humidifies the ejection space while the sealing mechanism is in the sealing state, wherein the controller is further configured to control the liquid ejection head to perform a non-ejection flushing in the humidification period except in a first period extending from a start of the humidification period for a predetermined period.

2. The liquid ejection apparatus according to claim 1, wherein the controller is configured to control the liquid ejection head to start the non-ejection flushing when the first period starting from the start of the humidification period expires.

3. The liquid ejection apparatus according to claim 2, wherein the controller is configured to:

determine the first period starting from the start of the humidification period on the basis of at least one of a humidity in the ejection space, a temperature in the ejection space, and a period elapsed from the last one of ejections of the liquid from the plurality of ejection openings; and control the liquid ejection head to start the non-ejection flushing in response to the expiration of the first period.

4. The liquid ejection apparatus according to claim 2, wherein the controller is configured to:

determine the first period starting from the start of the humidification period for each of the plurality of ejection openings such that the higher a viscosity of the liquid in the ejection opening, the longer the first period from the start of the humidification period is; and control the liquid ejection head to start the non-ejection flushing in response to the expiration of the first period.

5. The liquid ejection apparatus according to claim 1, wherein the controller is configured to:

determine a non-ejection flushing period for performing the non-ejection flushing, for each of the plurality of ejection openings, such that the higher a viscosity of the liquid in the ejection opening, the longer the non-ejection flushing period is; and control the liquid ejection head to start the non-ejection flushing in response to the expiration of the first period starting from the start of the humidification period.

6. The liquid ejection apparatus according to claim 5, wherein the controller is configured not to perform the non-ejection flushing for at least one ejection opening in each of which the viscosity of the liquid therein is less than a threshold, among the plurality of ejection openings.

7. The liquid ejection apparatus according to claim 1, wherein the controller is configured not to perform the non-ejection flushing for at least one ejection opening in each of which the liquid is not to be ejected onto the recording medium in the image recording, among the plurality of ejection openings.

8. The liquid ejection apparatus according to claim 1, wherein the controller is configured to start the non-ejection flushing for the plurality of ejection openings in order from an upstream ejection opening thereamong in a direction of a flow of the humid air supplied to the ejection space by the humid-air supply mechanism.

9. The liquid ejection apparatus according to claim 1, wherein the liquid ejection head includes:

a plurality of ejection-opening groups arranged side by side and each including at least one of the plurality of ejection openings; and a plurality of actuator units respectively corresponding to the plurality of ejection-opening groups and each including a plurality of actuators configured to respectively apply, to the liquid in the liquid ejection head, ejection energies for ejecting the liquid from a plurality of the ejection openings in a corresponding one of the plurality of ejection-opening groups, and wherein the controller is configured to control the plurality of actuator units individually in the non-ejection flushing.

10. The liquid ejection apparatus according to claim 1, wherein the controller is configured to determine a second period for performing the non-ejection flushing, for each of the plurality of ejection openings, and wherein the controller is configured to perform the non-ejection flushing intermittently for at least one ejection opening for which the second period for performing the non-ejection flushing is determined to be longer than the first period.

11. The liquid ejection apparatus according to claim 2, wherein the controller is configured to:

determine the first period starting from the start of the humidification period for each of the plurality of ejection openings such that the lower the humidity in the ejection space in the unsealing state, the longer the first period starting from the start of the humidification period is; and control the liquid ejection head to start the non-ejection flushing in response to the expiration of the first period.

12. The liquid ejection apparatus according to claim 1, wherein the controller is configured to:

determine the first period starting from the start of the humidification period for each of the plurality of ejection openings such that the higher the temperature in the ejection space in the unsealing state, the longer the first period starting from the start of the humidification period is; and control the liquid ejection head to start the non-ejection flushing in response to the expiration of the first period.

13. The liquid ejection apparatus according to claim 1, wherein the controller is configured to:

determine the first period starting from the start of the humidification period for each of the plurality of ejection openings such that the longer a period elapsed from the last one of ejections of the liquid from the plurality of ejection openings, the longer the first period starting from the start of the humidification period is; and control the liquid ejection head to start the non-ejection flushing in response to the expiration of the first period.

14. A controller configured to control a liquid ejection apparatus, the liquid ejection apparatus comprising:

a liquid ejection head having an ejection face that has a plurality of ejection openings formed therein, the liquid ejection head being configured to eject liquid through the plurality of ejection openings to record an image on a recording medium, an ejection space being defined so as to face the ejection face;

a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply, into the ejection space, humid air that has been humidified when the sealing mechanism is in the sealing state, the controller configured to:

control the sealing mechanism and the humid-air supply mechanism to humidify the ejection space in a humidification period in which the humid air supply mechanism humidifies the ejection space while the sealing mechanism is in the sealing state; and control the liquid ejection head to perform a non-ejection flushing in the humidification period except in an initial period extending from a start of the humidification period for a predetermined period.

15. A nonvolatile storage medium storing a program including computer-readable instructions for controlling a liquid ejection apparatus, the liquid ejection apparatus comprising:

a liquid ejection head having an ejection face that has a plurality of ejection openings formed therein, the liquid ejection head being configured to eject liquid through the plurality of ejection openings to record an image on a recording medium, an ejection space being defined so as to face the ejection face;

a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply, into the ejection space, humid air that has been humidified when the sealing mechanism is in the sealing state, the computer-readable instructions, when executed by a processor, instructing the liquid ejection apparatus to:

control the sealing mechanism and the humid-air supply mechanism to humidify the ejection space in a humidification period in which the humid air supply mechanism humidifies the ejection space while the sealing mechanism is in the sealing state; and control the liquid ejection head to perform a non-ejection flushing in the humidification period except in an initial period extending from a start of the humidification period for a predetermined period.

* * * * *